US009501021B2

(12) United States Patent
Yamazaki

(10) Patent No.: US 9,501,021 B2
(45) Date of Patent: Nov. 22, 2016

(54) SHEET PROCESSING APPARATUS AND IMAGE FORMING APPARATUS HAVING BINDING PROCESSING FUNCTION

(71) Applicant: CANON KABUSHIKI KAISHA, Tokyo (JP)

(72) Inventor: Yoshitaka Yamazaki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 120 days.

(21) Appl. No.: 14/602,118

(22) Filed: Jan. 21, 2015

(65) Prior Publication Data

US 2015/0205243 A1 Jul. 23, 2015

(30) Foreign Application Priority Data

Jan. 23, 2014 (JP) ..... 2014-010446
Jan. 9, 2015 (JP) ..... 2015-003136

(51) Int. Cl.

| | |
|---|---|
| ***B65H 7/20*** | (2006.01) |
| ***G03G 15/00*** | (2006.01) |
| ***B65H 37/04*** | (2006.01) |
| ***B31F 5/02*** | (2006.01) |
| ***B42F 3/00*** | (2006.01) |
| ***B42B 5/00*** | (2006.01) |

(52) U.S. Cl.

CPC ..... *G03G 15/6541* (2013.01); *B31F 5/02* (2013.01); *B42B 5/00* (2013.01); *B42F 3/003* (2013.01); *B65H 7/20* (2013.01); *B65H 37/04* (2013.01); *G03G 15/6544* (2013.01); *B31F 2201/0712* (2013.01); *B31F 2201/0779* (2013.01); *B65H 2301/43828* (2013.01); *B65H 2301/51616* (2013.01); *B65H 2801/27* (2013.01); *G03G 15/55* (2013.01); *G03G 2215/00852* (2013.01)

(58) Field of Classification Search

CPC ..... B31F 5/02; B31F 2201/0712; B31F 2201/0779; B65H 2301/51616; B42F 3/003; G03G 2215/00852

USPC ..... 270/58.07, 58.08, 58.09

See application file for complete search history.

(56) References Cited

U.S. PATENT DOCUMENTS

| | | | | |
|---|---|---|---|---|
| 5,573,233 | A * | 11/1996 | Hirai et al. | 270/58.08 |
| 7,240,898 | B2 * | 7/2007 | Takamura et al. | 270/58.09 |
| 7,404,550 | B2 * | 7/2008 | Vogel et al. | 270/52.18 |
| 8,342,499 | B2 * | 1/2013 | Shiraishi et al. | 270/58.08 |

FOREIGN PATENT DOCUMENTS

| | | |
|---|---|---|
| JP | 2004155537 A | 6/2004 |
| JP | 2005206374 A | 8/2005 |
| JP | 2013123817 A | 6/2013 |

* cited by examiner

*Primary Examiner* — Leslie A Nicholson, III
(74) *Attorney, Agent, or Firm* — Canon USA, Inc., IP Division

(57) ABSTRACT

A sheet processing apparatus includes a binding unit configured to perform binding processing by pressing a sheet bundle, a motor configured to drive the binding unit to press the sheet bundle, a speed detection unit configured to detect a speed of the motor, a voltage detection unit configured to detect a driving voltage of the motor, and a motor control unit configured to determine an upper limit value of a driving current of the motor based on the speed detected by the speed detection unit and the driving voltage detected by the voltage detection unit in a period when the motor is being driven and the binding unit is not pressing the sheet bundle.

14 Claims, 9 Drawing Sheets

SHEET PROCESSING APPARATUS AND IMAGE FORMING APPARATUS HAVING BINDING PROCESSING FUNCTION

BACKGROUND

1. Field

Aspects of the present invention generally relate to a sheet processing apparatus and an image forming apparatus having a binding processing function.

2. Description of the Related Art

A stapling device has conventionally been used widely as a device for binding sheets on which images are formed by an image forming apparatus such as a copying machine and a printer. The stapling device performs binding processing to bind a sheet bundle including a plurality of sheets by using a binding member such as metal staples. However, when using each sheet of the sheet bundle stapled by the stapling device as a document to be read, the staples binding the sheet bundle need to be removed. When recycling the sheet bundle bound by staples, the staples binding the sheet bundle also need to be removed to separately collect the sheets and the staples from the viewpoint of environmental protection. Since the staples used for the binding processing are discarded after being used, there has been a problem in terms of reuse of resources.

Japanese Patent Application Laid-Open No. 2004-155537 discusses a sheet binding device that uses no binding member such as a staple to reduce time and effort when reusing the sheets as a document or at the time of recycling. Using no staples, such a sheet binding device discards no staples. The sheet binding device is configured to, after a plurality of sheets conveyed from an image forming apparatus is bundled and aligned into a sheet bundle, press against the sheets a tooth die having protrusions and recesses for forming recesses and protrusions in part of the sheet bundle. The sheet binding device performs binding processing by thus pressing the sheet bundle to entangle fibers of the sheet bundle with each other.

If the conventional stapleless binding method described above is applied to an image forming apparatus, an actuator can be used as a driving source for pressing the tooth die having protrusions and recesses against the sheet bundle to automate the pressing operation. In the stapleless binding processing, steady application of constant pressing force to the sheet bundle is important in maintaining the quality of the sheet bundle after undergoing the binding processing so that the retention force of the binding portion lasts and the bound portion will not get broken. However, actuators have individual variations in output torque characteristics even under a constant operating condition (constant driving voltage and driving current). This leads to variations in the pressing force applied to the sheet bundle. Aside from individual variations, the output torque characteristics of the actuator also vary with temperature of an operating environment, use time, and use frequency of the image forming apparatus. Consequently, if the output torque is low, a phenomenon in which the sheet bundle easily exfoliates (hereinafter, referred to as poor binding) can occur. If the output torque is high, the application of excessive pressure to the sheet bundle can break the sheets. In addition, since high output torque produces pressure more than needed for the binding processing, not only the tooth die but also the mechanism linked to the tooth die needs to have high strength. Therefore, cost for improving the strength of the materials and a size of the mechanism are increased.

SUMMARY

Aspects of the present invention are generally directed to a sheet processing apparatus and an image forming apparatus that can improve quality of stapleless binding processing and reduce its size and cost.

According to an aspect of the present invention, a sheet processing apparatus includes a binding unit configured to perform binding processing by pressing a sheet bundle, a motor configured to drive the binding unit to press the sheet bundle, a speed detection unit configured to detect a speed of the motor, a voltage detection unit configured to detect a driving voltage of the motor, and a motor control unit configured to determine an upper limit value of a driving current of the motor based on the speed detected by the speed detection unit and the driving voltage detected by the voltage detection unit in a period when the motor is being driven and the binding unit is not pressing the sheet bundle.

Further features of the present disclosure will become apparent from the following description of exemplary embodiments with reference to the attached drawings.

DESCRIPTION OF THE EMBODIMENTS

Figure 1A:
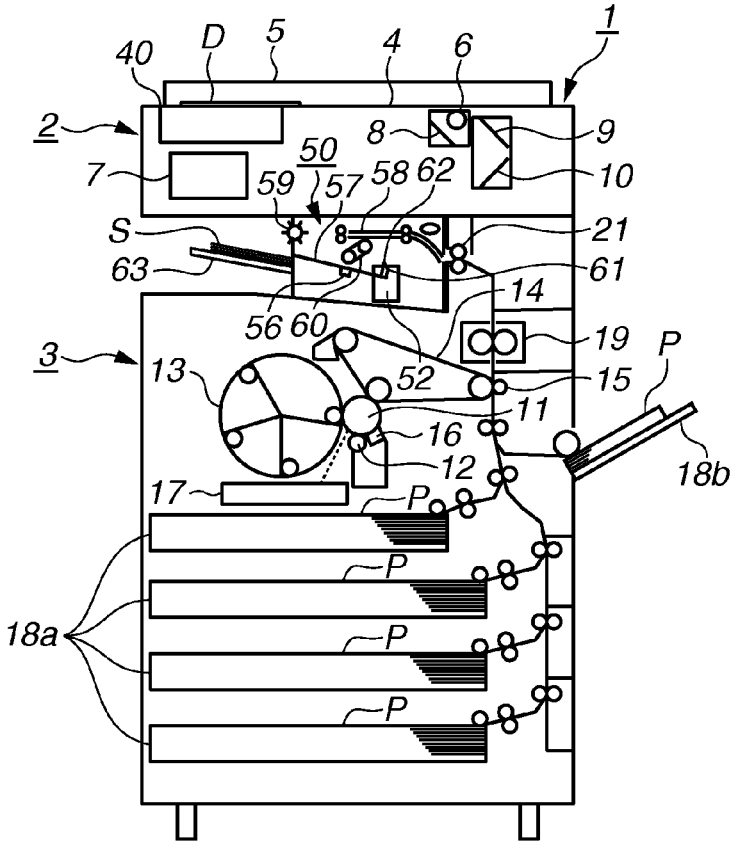
FIGS. 1A and 1B are diagrams illustrating a configuration of an image forming apparatus and a sheet processing apparatus.

Exemplary embodiments will be described in detail below with reference to the drawing.

Image Forming Apparatus

FIG. 1A is a schematic cross-sectional view of an image forming apparatus and a sheet processing apparatus serving as an image forming system according to a first exemplary embodiment. FIG. 1A illustrates the image forming apparatus 1 in which its front side (front face) is situated on the near side. The image forming apparatus 1 includes an image reading unit 2, an image forming unit 3, and a sheet processing apparatus 50. A user sets a job into the image forming apparatus 1 from an operation unit or from an external apparatus such as a personal computer (PC) via a network. If the set job is a copy operation, the image forming apparatus 1 performs image forming processing and post-processing of the sheet based on image data from the image reading unit 2. If the set job is a print operation, the image forming apparatus 1 performs image forming processing and post-processing of the sheet based on image data transmitted from the PC via the network.

The image reading unit 2 will be described. A platen 4 including a transparent glass plate is fixed on an upper part of the image reading unit 2. A document D is placed on a predetermined position of the platen 4 with an image side down. The document D is pressed and seated by a platen cover 5. An optical system including a lamp 6 for illuminating the document D and reflection mirrors 8, 9, and 10 for guiding an optical image of the illuminated document D to an image processing unit 7 is arranged under the platen 4. The image processing unit 7 includes an image sensor. The lamp 6 and the reflection mirrors 8, 9, and 10 move at a predetermined speed to scan the document D and transmit image data to the image forming unit 3.

The image forming unit 3 includes a photosensitive drum 11, a primary charging roller 12, a rotary developing unit 13, an intermediate transfer belt 14, a transfer roller 15, and a cleaner 16. The photosensitive drum 11 is irradiated with laser light from a laser unit 17 based on image data, whereby an electrostatic latent image is formed on the surface of the photosensitive drum 11. The primary charging roller 12 uniformly charges the surface of the photosensitive drum 11 before the laser light irradiation. The rotary developing unit 13 makes magenta (M), cyan (C), yellow (Y), and black (K) color toners adhere to the electrostatic latent image formed on the surface of the photosensitive drum 11, thereby forming a toner image. When specifying color, the symbols M, C, Y, and K will be attached to reference numerals. The toner image developed on the surface of the photosensitive drum 11 is transferred to the intermediate transfer belt 14, and the toner image on the intermediate transfer belt 14 is transferred to a sheet P in a transfer position by the transfer roller 15. The cleaner 16 removes toners remaining on the photosensitive drum 11 after the transfer of the toner image.

The toner image developed on the photosensitive drum 11 by the rotary developing unit 13 is transferred to the intermediate transfer belt 14. The toner image on the photosensitive belt 14 is transferred to the sheet P by the transfer roller 15. The sheet P is supplied from a sheet cassette 18*a*. The sheet P may be supplied from a manual feed tray 18*b*. A fixing unit 19 is arranged on a downstream side of the image forming unit 3 in a conveyance direction of the sheet P (hereinafter, simply referred to as a downstream side). The fixing unit 19 performs fixing processing on the toner image on the conveyed sheet P. The sheet P on which the toner image is fixed by the fixing unit 19 is discharged from the image forming apparatus 1 to the sheet processing apparatus 50 on the downstream side by a discharge roller pair 21. The portion where the sheet P is discharged by the discharge roller pair 21 will be referred to as a sheet discharge section.

Sheet Processing Apparatus

Figure 1B:
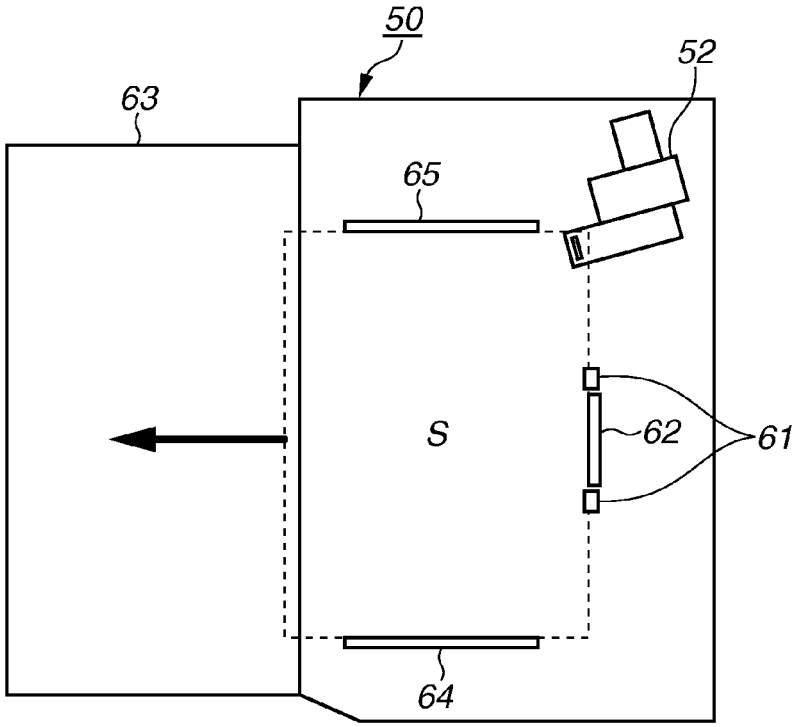

Next, the sheet processing apparatus 50 will be described. As illustrated in FIG. 1A, the sheet processing apparatus 50 is arranged in the sheet discharge section of the image forming apparatus 1. The sheet processing apparatus 50 communicates with the image forming apparatus 1 via a not-illustrated signal line to operate in cooperation with the image forming apparatus 1. FIG. 1B is a view of the sheet processing apparatus 50 from above, with the image reading unit 2 detached. Some of the members illustrated in FIG. 1A are omitted in FIG. 1B. The bottom side of FIG. 1B corresponds to the front side (near side) of the image forming apparatus 1 illustrated in FIG. 1A. In FIG. 1B, a thick black arrow indicates the conveyance direction of a sheet bundle S illustrated in broken lines after binding processing.

The sheet processing apparatus 50 includes a stapleless binding device 52 which bundles a plurality of sheets P discharged from the image forming apparatus 1 into a sheet bundle S and performs binding processing by entangling fibers of the sheet bundle S with each other without using a binding member such as a staple. The stapleless binding device 52 includes tooth dies (upper teeth 97 and lower teeth 98; see FIG. 2) having protrusions and recesses arranged to be opposed to each other for forming embossed protrusions and recesses in part of the sheet bundle S. The stapleless binding device 52 bundles and aligns a plurality of sheets P conveyed from the image forming apparatus 1 into a sheet bundle S, and then sandwiches the sheet bundle S inserted between the tooth dies having the protrusions and recesses. The stapleless binding device 52 then performs binding processing by pressing the tooth dies against the sheet bundle S sandwiched between the tooth dies having the protrusions and recesses to entangle the fibers of the sheet bundle S with each other. Hereinafter, the binding processing for performing binding by entangling the fibers of the sheet bundle S with each other without using a binding member such as a staple will be referred to as "stapleless binding" processing.

After a sheet P discharged from the image forming apparatus 1 is received by a conveyance unit 58, the sheet processing apparatus 50 performs accelerated conveyance in which the conveyance speed of the sheet P is accelerated from the speed driven within the image forming apparatus 1. After the conveyance of the sheet P from the conveyance unit 58, the sheet processing apparatus 50 drives a paddle roller 59 to rotate, whereby the sheet P is stacked on a processing tray 57. The sheet processing apparatus 50 further performs trailing edge alignment processing in which a return roller 60 makes the trailing edge of the sheet P abut on a trailing edge alignment plate 62, whereby the trailing edges of the stacked sheets P are aligned.

A sheet sensor 56 is a sensor that detects the presence and absence of sheets P on the processing tray 57. The sheet bundle S including the plurality of sheets P having undergone the trailing edge alignment processing in the processing tray 57 is aligned in a sheet width direction by alignment plates 64 and 65 and stacked on the processing tray 57. The sheet width direction refers to a direction orthogonal to the conveyance direction of the sheets P. The sheet processing apparatus 50 repeats this series of operations. If the stapleless binding processing is specified in a job, a specified number of sheets P are stacked on the processing tray 57 and then the stapleless binding device 52 performs the binding processing on the position illustrated in FIG. 1B. More specifically, the stapleless binding device 52 performs the binding processing on either one of the rear corners of the sheet bundle S. The position for performing the stapleless binding processing is not limited to the position illustrated in FIG. 1B. After the completion of the binding processing by the stapleless binding device 52, the sheet bundle S is discharged to a discharge tray 63 along the bottom surface of the processing tray 57 such that the trailing edge side of the sheet bundle S is pushed out by bundle pressing members 61.

Stapleless Binding Device

Figure 2A:
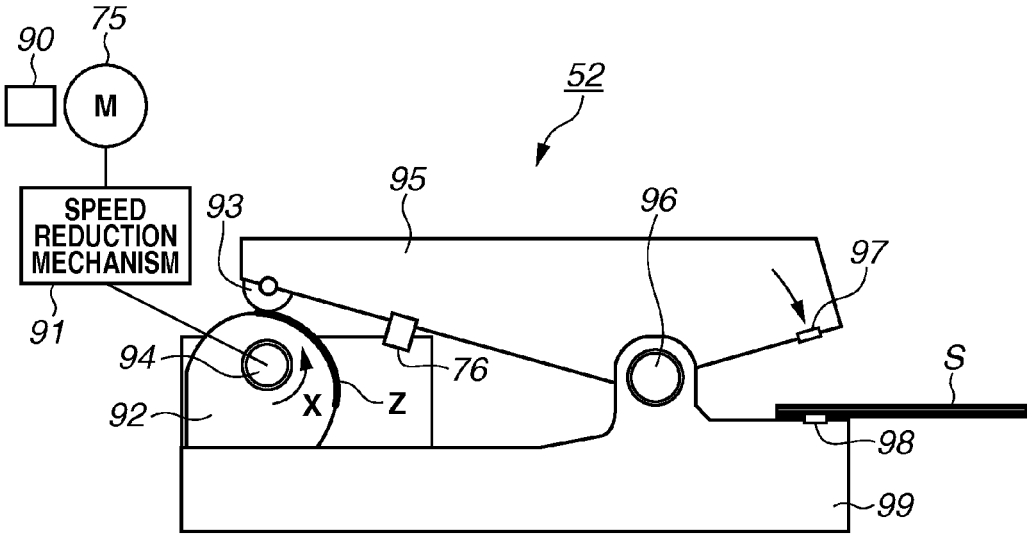
FIGS. 2A and 2B are diagrams illustrating a configuration of a stapleless binding device.
Figure 2B:
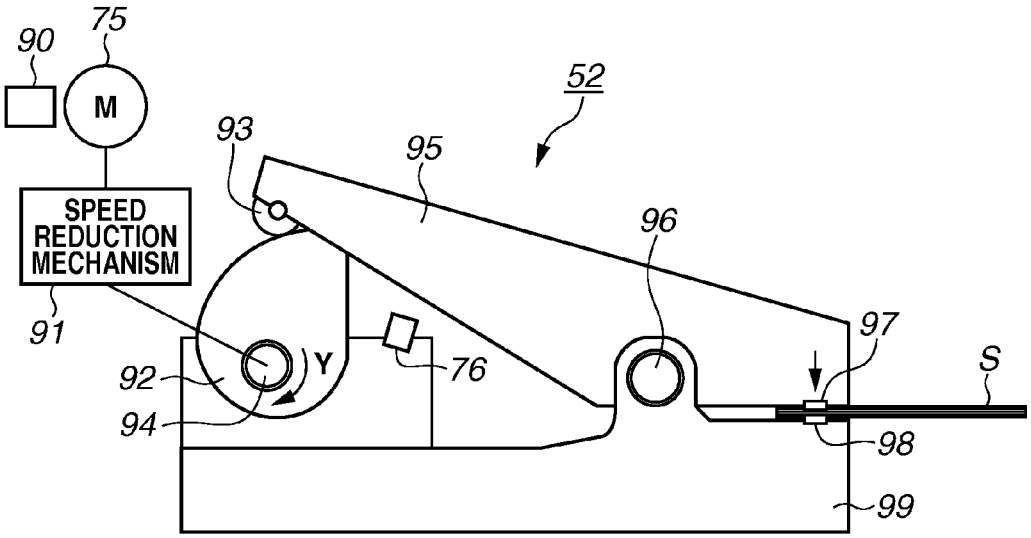

A detailed configuration of the stapleless binding device 52 will be described with reference to FIGS. 2A and 2B. FIG. 2A illustrates a waiting state where the stapleless binding device 52 is not performing a binding operation. FIG. 2B illustrates a binding state. In the stapleless binding device 52, an output shaft of a stapleless binding motor 75 (hereinafter, referred to simply as a motor; in FIGS. 2A and 2B, denoted as M) is connected to a cam rotation shaft 94 via a speed reduction mechanism 91 including a gear. In the present exemplary embodiment, the motor 75 is a direct-current (DC) brush motor. An encoder sensor 90 serving as a speed detection unit for measuring rotation speed, that is, the number of rotations per unit time, is arranged on the output shaft of the motor 75. The encoder sensor 90 is an optical sensor. The encoder sensor 90 detects slits formed in a disk on the output shaft of the motor 75, and outputs a pulse signal whose period varies with the rotation speed of the motor 75. A central processing unit (CPU) 162 to be described below (see FIG. 3) can detect the rotation speed of the motor 75 based on the pulse signal input from the encoder sensor 90. In the present exemplary embodiment, the disk arranged on the output shaft of the motor 75 is configured to have 18 slits in circumference.

According to the rotation of the cam rotation shaft 94, a cam 92 actuates an upper arm 95 via a roller 93. The upper teeth 97 serving as a first pressing unit for pressing one surface of the sheet bundle S are attached to the upper arm 95. The upper arm 95 swings about an arm shaft 96. A lower arm 99 is fixed to a casing frame of the sheet processing apparatus 50. The lower teeth 98 serving as a second pressing member for pressing the other surface of the sheet bundle S are attached to the lower arm 99. The lower teeth 98 are arranged to be opposed to the upper teeth 97. The protrusions and recesses of the tooth dies described above correspond to the upper teeth 97 and the lower teeth 98. Whichever may correspond to the protrusions or recesses. In the present exemplary embodiment, the lower arm 99 is configured to be fixed to the casing frame of the sheet processing apparatus 50. However, the upper arm 95 may be configured to be fixed to the casing frame. Both the upper arm 95 and the lower arm 99 may be configured not to be fixed to the casing frame.

The lower teeth 98 attached to the lower arm 99 and the upper teeth 97 attached to the upper arm 95 sandwich the sheet bundle S and mesh with each other to press the sheet bundle S. The surface of each sheet P of the pressed sheet bundle S is stretched by the upper and lower teeth 97 and 98 meshing with each other, to expose fibers. As the sheet bundle S is further pressed by the upper teeth 97 and the lower teeth 98, the fibers of the sheets P entangle with each other to fasten the sheet bundle S. In such a manner, the sheet bundle S can be fastened without using a binding member such as a staple.

When the sheet S is stacked on the processing tray 57, the cam 92 is in the position illustrated in FIG. 2A. Such a position will be referred to as a bottom dead center of the cam 92. If the cam 92 is positioned at the bottom dead center, a reference sensor 76 detects the upper arm 95. The reference sensor 76 outputs an ON signal to the CPU 162 when the upper arm 95 is detected. In other words, the state illustrated in FIG. 2A where the cam 92 is at the bottom dead center is a state (initial state) before a start of driving by the motor 75. As illustrated in FIG. 2A, when the cam 92 is positioned at the bottom dead center, there is a gap between the upper teeth 97 and the lower teeth 98, and the sheet bundle S can enter the gap. The cam 92 has a droplet shape, for example. While the roller 93 is in contact with a Z portion (thick line portion) illustrated in FIG. 2, a load acting on the motor 75 is negligibly small even if the motor 75 is driving the cam 92. The cam 92 may be shaped so that no load is imposed on the motor 75 while the roller 93 is in contact with the Z portion. The Z portion is an area along a predetermined ridge line distance (thick line portion in FIG. 2A) on the outer periphery of the cam 92 from the bottom dead center of the cam 92. When the motor 75 starts to drive the cam 92, the cam rotation shaft 94 rotates in an X direction (counterclockwise). Together with the rotation of the cam 92, the upper arm 95 starts to move and the reference sensor 76 no longer stops detecting the upper arm 95. The load acting on the motor 75 is negligible as long as the roller 93 is in contact with the Z portion. In the period when the roller 93 is in contact with the Z portion, the upper teeth 97 do not press the sheet bundle S. The Z portion of the cam 92 is thus shaped to make the load on the motor 75 extremely small. Via the speed reduction mechanism 91, the torque of the motor 75 is under a substantially zero load.

The stapleless binding device 52 starts a binding operation, and the cam 92 is further rotated in the X direction about the cam rotation shaft 92 by the driving of the motor 75. If the cam rotation shaft 94 of the cam 92 thus continues rotating in the X direction, the contact portion between the roller 93 and the cam 92 separates from the area of the Z portion and the load acting on the motor 75 increases. The upper teeth 97 and the lower teeth 98 mesh with each other in the positional relationship illustrated in FIG. 2B. When the cam 92 is in the position of FIG. 2B, its position is referred to as a top dead center. A driving current of the motor 75 here is adjusted to control the pressure occurring between the upper teeth 97 and the lower teeth 98 such that the upper teeth 97 and the lower teeth 98 mesh at a predetermined pressure. The motor 75 is then reversely rotated in a Y direction (clockwise) about the cam rotation shaft 94. When the cam 92 reaches the bottom dead center illustrated in FIG. 2A again, the reference sensor 76 detects the upper arm 95. If the reference sensor 76 detects the upper arm 95, the CPU 162 to be described below stops driving the motor 75 and the cam 92 stops rotating.

Control Blocks of Image Forming Apparatus and Sheet Processing Apparatus

Figure 3:
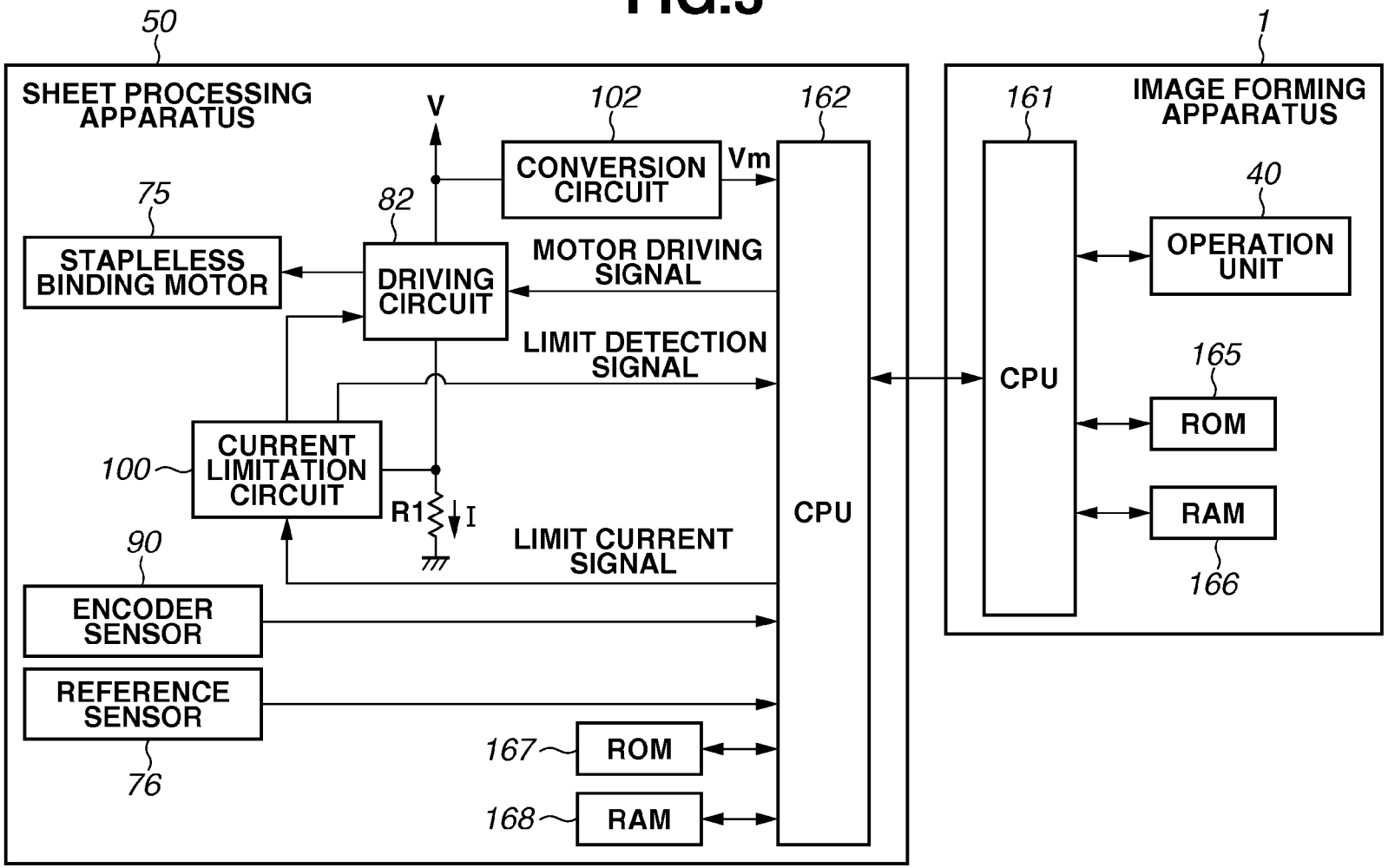
FIG. 3 is a block diagram of the image forming apparatus and the sheet processing apparatus.

Next, control blocks of the image forming apparatus 1 including the sheet processing apparatus 50 illustrated in FIG. 1A will be described with reference to FIG. 3. The image forming apparatus 1 includes a CPU 161, a read-only memory (ROM) 165, a random access memory (RAM) 166, and the operation unit 40. The CPU 161 controls the image forming apparatus 1. The ROM 165 stores a program and data for controlling the image forming apparatus 1. The RAM 166 is used to read and write processing data when the CPU 161 controls the image forming apparatus 1. The operation unit 40 accepts from the user the settings of a post-processing method to be carried out in the image forming apparatus 1 and the sheet processing apparatus 50. In the present exemplary embodiment, the execution of the stapleless binding processing can be selected as a post-processing method. The CPU 161 can communicate with the operation unit 40 to recognize information set by the user operating the operation unit 40 (also referred to as setting information). The sheet processing apparatus 50 includes the CPU 162, a ROM 167, and a RAM 168. The CPU 162 is a control unit that controls the sheet processing apparatus 50.

The CPU 162 can communicate with the CPU 161 of the image forming apparatus 1 to detect the states of each other. The ROM 167 stores a program and data for controlling the sheet processing apparatus 50. The RAM 168 is used to read and write processing data when the CPU 162 controls the sheet processing apparatus 50.

The motor 75, the encoder sensor 90, and the reference sensor 76 are included in the stapleless binding device 50 (see FIGS. 2A and 2B). When the upper arm 95 is in the position for accepting the sheet bundle S (the state of FIG. 2A), the reference sensor 76 detects the position as a reference position. The reference sensor 76 then transmits the CPU 162 of the detection of the upper arm 95. The CPU 162 detects whether the upper arm 95 is in the reference position by using the reference sensor 76. The CPU 162 outputs a motor driving signal to a driving circuit 82. The CPU 162 thereby controls driving/stopping of the motor 75 via the driving circuit 82 to perform the binding processing of the stapleless binding device 52. When controlling the driving of the motor 75, the CPU 162 can specify a rotation direction of the motor 75. A driving voltage V is input to the driving circuit 82 and used as a power source for driving the motor 75. A voltage level of the driving voltage V is converted by a conversion circuit 102 and then input to the CPU 162 as a voltage Vm. The CPU 162 detects the voltage level of the driving voltage V from the input voltage Vm. In other words, the CPU 162 also functions as a voltage detection unit. A shunt resistor R1 is inserted between the driving circuit 82 and the ground, and used to detect a driving current I of the motor 75.

A current limitation circuit 100 includes a comparator, and compares a limit current signal input from the CPU 162 with a voltage according to the current flowing through the shunt resistor R1. The current flowing through the shunt resistor R1 is the driving current I of the motor 75. The limit current signal input from the CPU 162 is an analog variable voltage signal. The limit current signal is a signal which maintains the driving current I of the motor 75 at a predetermined value for a predetermined time. The predetermined time refers to time needed to mutually fasten the sheets of the sheet bundle S pressed by the upper teeth 97 and the lower teeth 98. The current limitation circuit 100 compares the voltage signal from the shunt resistor R1 with the limit current signal, and controls the driving circuit 82 so that the driving current I of the motor 75 becomes the predetermined value according to the limit current signal. The current limitation circuit 100 outputs a limit detection signal to the CPU 162 when the driving current I of the motor 75 reaches the predetermined value (current value) according to the limit current signal (voltage signal). In other words, the current limitation circuit 100 functions as a current detection unit.

When the motor 75 is driven, the encoder sensor 90 inputs a pulse signal having a frequency proportional to the rotation speed of the motor 75, to the CPU 162. The CPU 162 calculates the rotation speed of the motor 75 by measuring edge intervals of the pulse signal input from the encoder sensor 90 by using a not-illustrated timer.

Processing on Image Forming Apparatus Side

Figure 4A:
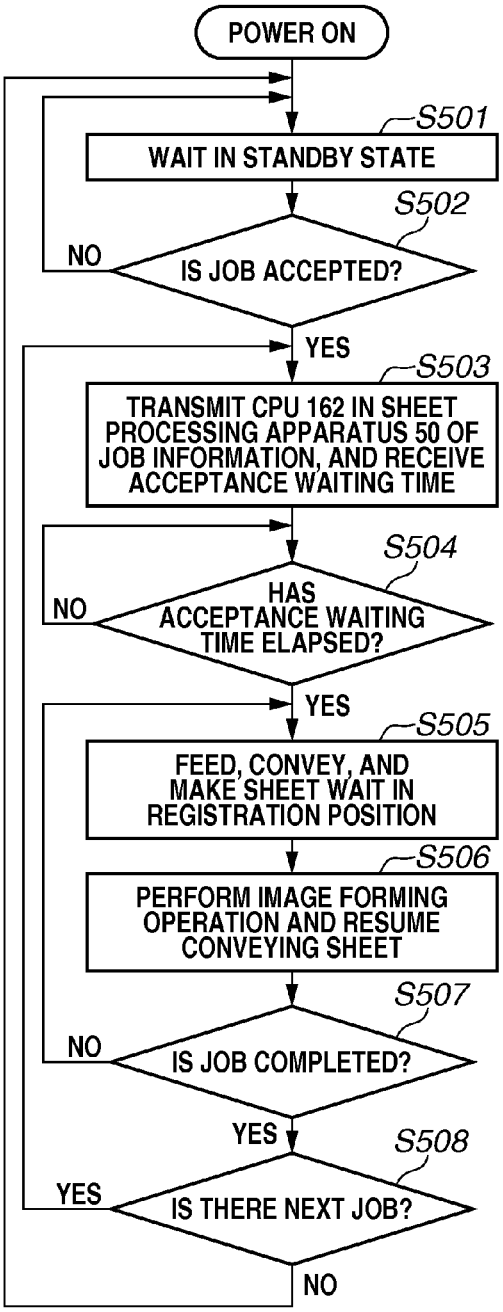
FIGS. 4A and 4B are flowcharts illustrating processing on an image forming apparatus side and a sheet processing apparatus side.
Figure 4B:
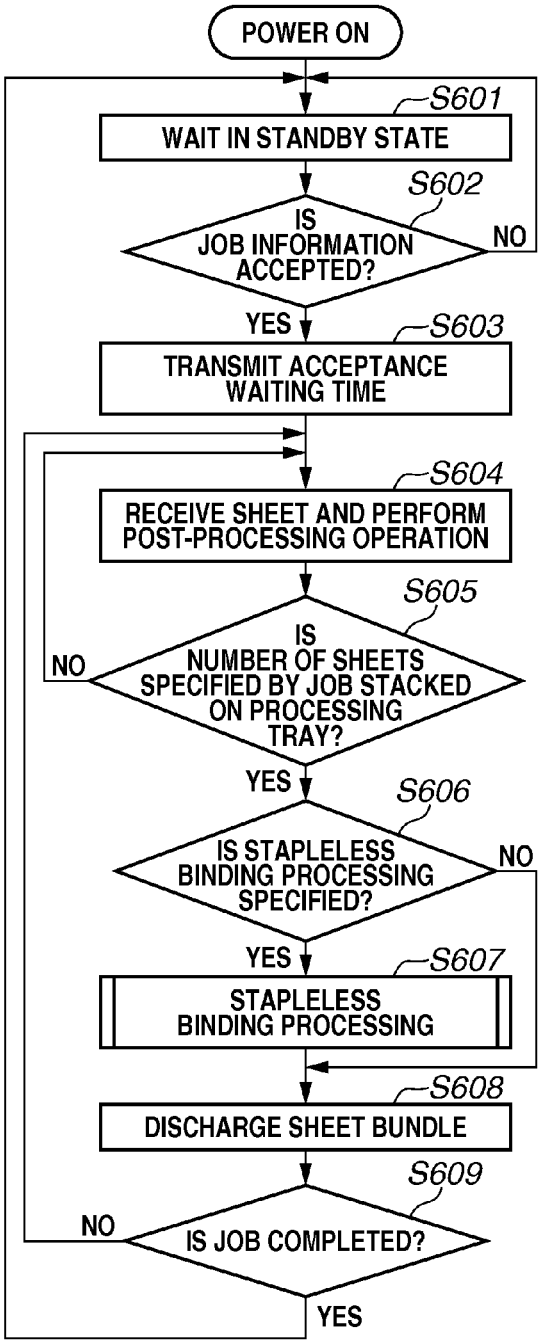

A stapleless binding control sequence using the stapleless binding device 52 of the sheet processing apparatus 50 according to information about a job (hereinafter, referred to as job information) from the image forming apparatus 1 will be described. FIG. 4A is a flowchart of control executed by the CPU 161 of the image forming apparatus 1. FIG. 4B is a flowchart of control executed by the CPU 162 of the sheet processing apparatus 50.

When the image forming apparatus 1 is powered on (power on), the CPU 161 of the image forming apparatus 1 starts the following control. In step S501, the CPU 161 performs an initialization operation and then makes the image forming apparatus 1 wait in a standby state. The standby state refers to a state in which the image forming apparatus 1 waits for the acceptance of a job from the operation unit 40 or the external apparatus. The image forming apparatus 1 can immediately perform an image forming operation when a job is accepted. In step S502, the CPU 161 determines whether a job is accepted from the operation unit 40 or via the network. In step S502, if the CPU 161 determines that a job is not accepted (NO in step S502), the processing returns to step S501. In other words, the CPU 161 maintains the standby state until a job is accepted. The image forming apparatus 1 and the sheet processing apparatus 50 may be configured to shift from the standby state to a power saving state if the state of not accepting a job has lasted for a predetermined time.

In step S502, if the CPU 161 determines that a job is accepted (YES in step S502), then in step S503, the CPU 161 transmits the CPU 162 in the sheet processing apparatus 50 of the accepted job information, and receives acceptance waiting time according to the job information from the CPU 162. The acceptance waiting time refers to a predetermined time needed for the sheet processing time 50 to become ready to start a post-processing operation after receiving a sheet P from the image forming apparatus 1. The CPU 161 resets and starts a not-illustrated timer here. In step S504, the CPU 161 refers to the not-illustrated timer to determine whether the acceptance waiting time received from the CPU 162 in step S503 has elapsed. In step S504, if the CPU 161 determines that the acceptance waiting time has not elapsed (NO in step S504), the processing of step S504 is repeated. In step S504, if the CPU 161 determines that the acceptance waiting time has elapsed (YES in step S504), the processing proceeds to step S505. In step S505, the CPU 161 feeds a sheet P from a sheet cassette 18*a*, conveys the sheet P over the conveyance path, and makes the sheet P wait in a registration position. The registration position is a waiting position for adjusting the timing at which an image is transferred onto the sheet P. In step S506, the CPU 161 performs an image forming operation and resumes conveying the sheet P from the registration position in synchronization with image formation timing. That is, a toner image is transferred onto the sheet P in the transfer position. The fixing unit 19 fixes the unfixed toner image to the sheet P, and then the sheet P is discharged to the sheet processing apparatus 50.

In step S507, the CPU 161 determines whether a predetermined number of sheets has been processed (the job is completed) according to the job information. If the CPU 161 determines that the job is not completed (NO in step S507), the processing returns to step S505. In step S507, if the CPU 161 determines that the job is completed (YES in step S507), then in step S508, the CPU 161 determines whether there is a next job, i.e., whether a next job has been accepted and waiting. In step S508, if the CPU 161 determines that there is a next job (YES in step S508), the processing returns to step S503. If the CPU 161 determines that there is no next job (NO in step S508), the processing returns to step S501.

Processing on Sheet Processing Apparatus Side

Next, a control flowchart of the CPU 162 of the sheet processing apparatus 50 will be described with reference to FIG. 4B. When the image forming apparatus 1 is powered on, the sheet processing apparatus 50 is also supplied with power from the image forming apparatus 1 (power on). The power supply activates the CPU 162, and the CPU 162 starts the processing of steps S601 and later. In step S601, the CPU 162 performs an initialization operation of the sheet processing apparatus 50 and then waits in a standby state. In step S602, the CPU 162 determines whether job information is transmitted (job information is accepted) from the CPU 161 of the image forming apparatus 1. In step S602, if the CPU 162 determines that job information is not accepted (NO in step S602), the processing returns to step S601. In step S602, if the CPU 162 determines that job information is accepted (YES in step S602), the processing proceeds to step S603. In step S603, the CPU 162 transmits the CPU 161 in the image information apparatus 1 of the predetermined acceptance waiting time in which the sheet processing apparatus 50 becomes ready to receive a sheet P from the image forming apparatus 1 according to the job information received from the CPU 161. The processing on the side of the CPU 161 of the image forming apparatus 1 corresponds to the processing of step S503 of FIG. 4A described above.

The image forming apparatus 1 discharges a sheet P on which image formation has been completed, and the sheet processing apparatus 50 receives the sheet P. In step S604, the CPU 162 performs a post-processing operation by using the sheet processing apparatus 50. The post-processing operation performed by the sheet processing apparatus 50 is as follows: The CPU 162 makes the conveyance unit 58 convey the sheet P at accelerated conveyance speed, and then drives the puddle roller 49 to rotate so that the sheet P is fed into the processing tray 57. The CPU 162 then performs a trailing edge alignment operation in which a plurality of sheets P on the processing tray 57 is conveyed and made to abut on the trailing edge alignment plate 62 by the return roller 60, whereby the trailing edges of the plurality of sheets P are aligned. After the trailing edge alignment operation, the CPU 162 aligns the plurality of sheets P in the sheet width direction by using the alignment plates 64 and 65, and stacks the plurality of sheets P on the processing tray 57.

In step S605, the CPU 162 determines whether sheets P as many as specified by the job are stacked on the processing tray 57. If the CPU 162 determines that the specified number of sheets P are not stacked (NO in step S605), the processing returns to step S604. The CPU 162 counts the number of sheets discharged to the processing tray 57 by using a not-illustrated sensor arranged on a conveyance path, and determines whether the specified number of sheets P are stacked based on the count value. The sensor may be provided on the conveyance path of either the image forming apparatus 1 or the sheet processing apparatus 50. In step S605, if the CPU 162 determines that sheets P as many as specified by the job are stacked on the processing tray 57 (YES in step S605), the processing proceeds to step S606. In step S606, the CPU 162 determines whether the stapleless binding processing is specified based on the accepted job information. If the CPU 162 determines that the stapleless binding processing is not specified (NO in step S606), the processing proceeds to step S608. In step S606, if the CPU 162 determines that the stapleless binding processing is specified (YES in step S606), then in step S607, the CPU 162 performs the stapleless binding processing. The stapleless binding processing performed in step S607 will be described below with reference to FIG. 5. In step S608, the CPU 162 pushes out the trailing edge side of the sheet bundle S stacked on the processing tray 57 and discharges the sheet bundle S to the discharge tray 63 by using the bundle pressing members 61. In step S609, the CPU 162 determines whether the post-processing operation of a specified predetermined number of copies is completed (hereinafter, referred to as completion of the job) based on the job information. If the CPU 162 determines that the job is not completed (NO in step S609), the processing returns to step S604. In step S609, if the CPU 162 determines that the job is completed (YES in step S609), the processing returns to step S601.

Stapleless Binding Processing

Figure 5:
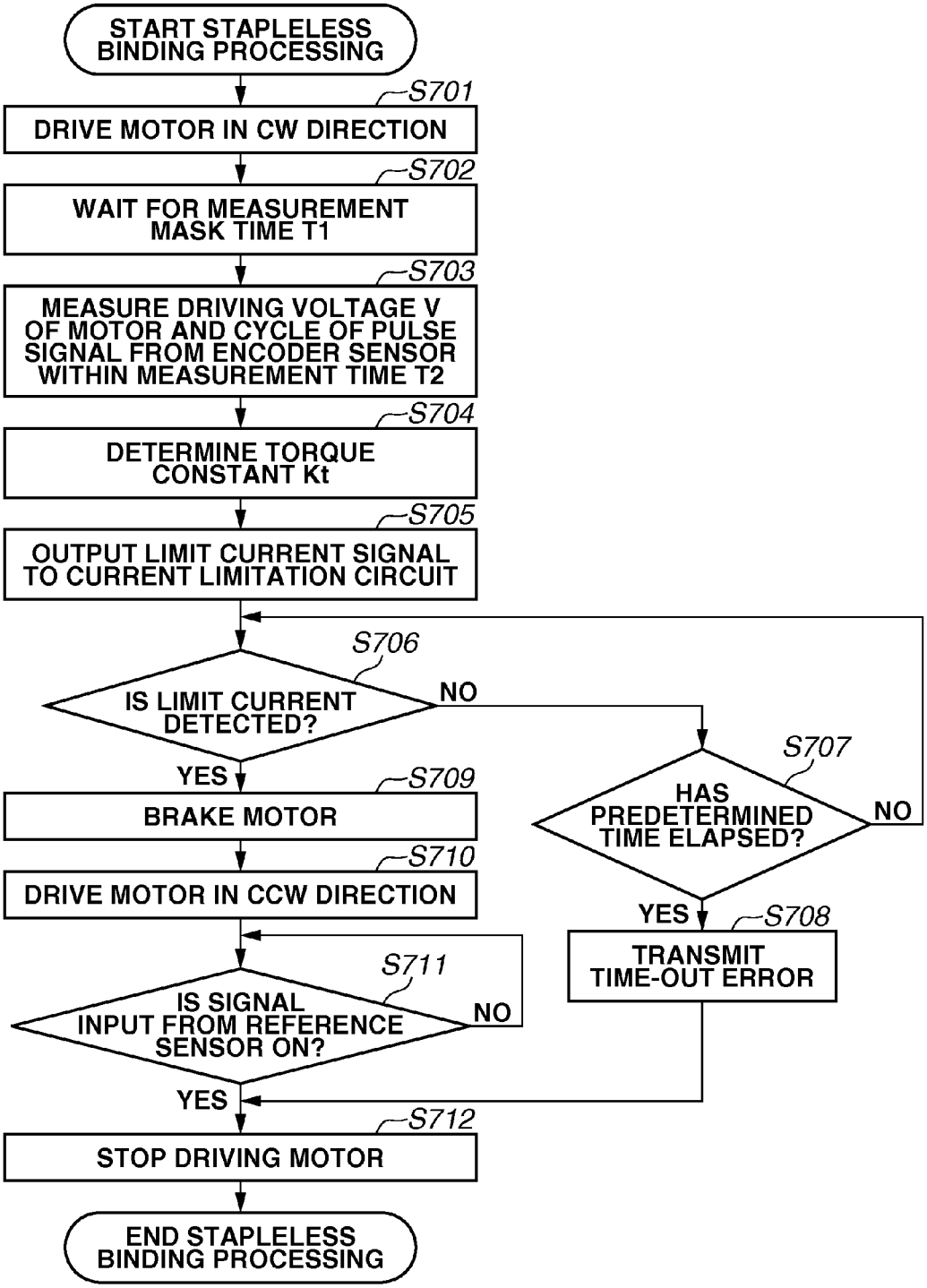
FIG. 5 is a flowchart illustrating stapleless binding processing of the sheet processing apparatus.
Figure 6:
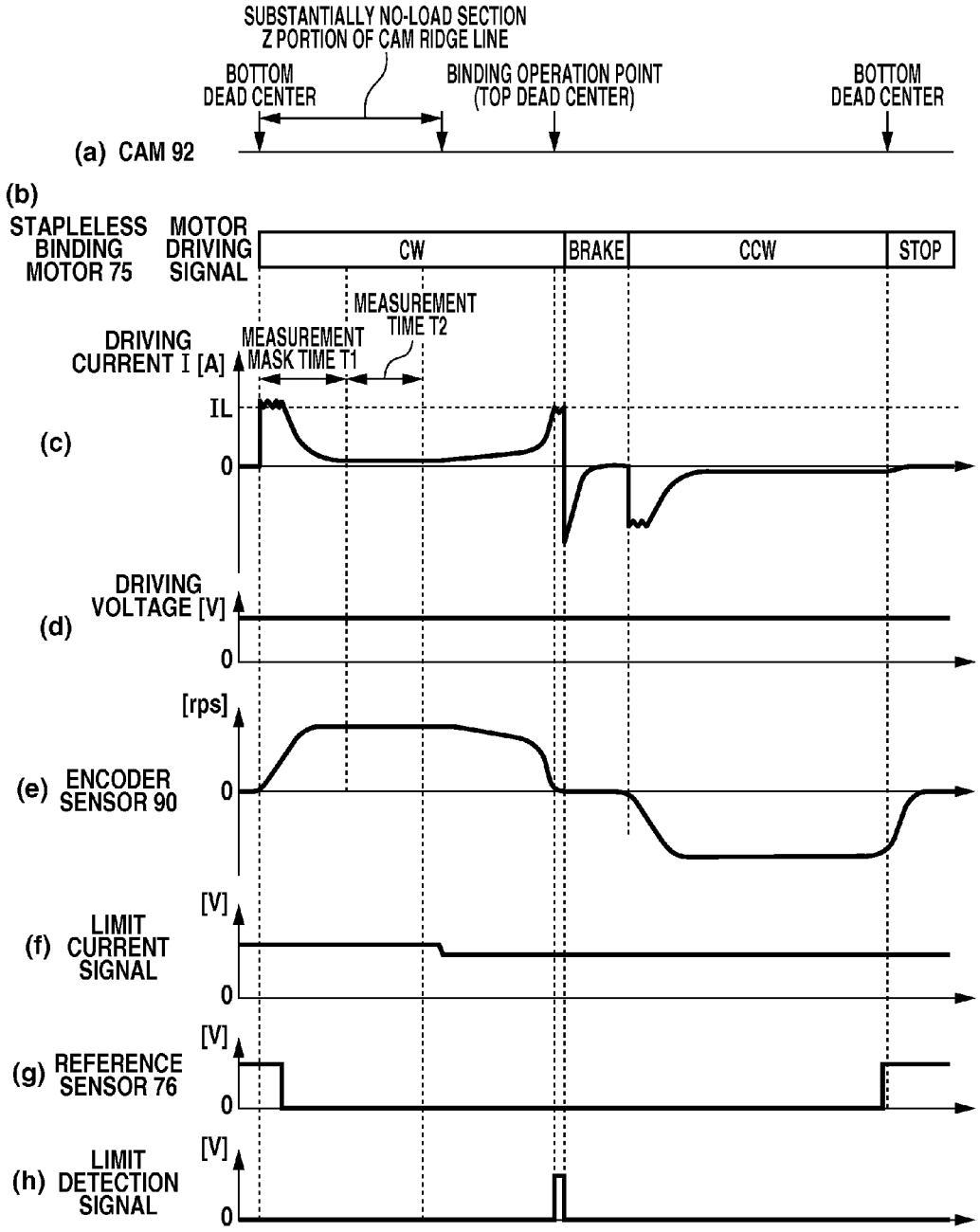
FIG. 6 is a timing chart illustrating an operation sequence during the stapleless binding processing.

Next, the stapleless binding processing by the CPU 162 of the sheet processing apparatus 50 will be described with reference to the flowchart of FIG. 5. FIG. 6 is a timing chart illustrating the signals of various parts of the sheet processing apparatus 50 during the stapleless binding processing. In FIG. 6, a state (a) indicates the states of the cam 92 described in FIGS. 2A and 2B, including the "bottom dead center" and a "binding operation point (top dead center)." A signal (b) of FIG. 6 indicates the motor driving signal of the motor 75. In FIG. 6, clockwise (CW) of the signal (b) represents forward rotation, BRAKE a stop of rotation, counterclockwise (CCW) reverse rotation, and STOP a stop of driving. In the present exemplary embodiment, CW is thus described as forward rotation and CCW reverse rotation. A waveform (c) of FIG. 6 indicates the waveform of the driving current I [A]. The limit current value stored in the RAM 168 is denoted as IL and indicated by a broken line. A waveform (d) of FIG. 6 indicates the waveform of the driving voltage V [V] for driving the motor 75. A waveform (e) of FIG. 6 indicates the number of rotations per unit time (second) [rps] of the motor 75 detected by the encoder sensor 90. A waveform (f) of FIG. 6 indicates the limit current signal [V] which the CPU 162 outputs to the current limitation circuit 100. A waveform (g) of FIG. 6 indicates the detection signal [V] that the reference sensor 76 outputs to the CPU 162. A waveform (h) of FIG. 6 indicates the limit detection signal [V] which the current limitation circuit 100 outputs to the CPU 162. The horizontal axis of FIG. 6 is time.

In step S607 of FIG. 4B, the CPU 162 performs the stapleless binding processing. In step S701 of FIG. 5, to perform the stapleless binding processing, the CPU 162 outputs the motor driving signal to the driving circuit 82 to drive the motor 75 in a forward rotation (CW) direction by the driving circuit 82. By driving the motor 75 in the forward rotation direction, the CPU 162 rotates the cam 92 in the X direction (counterclockwise) from the bottom dead center as illustrated in FIG. 2A. The CPU 162 resets and starts the not-illustrated timer here. In step S702, the CPU 162 refers to the not-illustrated timer and waits for a measurement mask time T1. The processing of step S702 is performed to exclude from measurement targets a period when the driving voltage and rotation speed of the motor 75 vary due to inertial load of the speed reduction mechanism 91 immediately after the start of driving. As indicated by the waveforms (c) and (e) of FIG. 6, the driving current I and the output of the encoder 90 are unstable during the period of the measurement mask time T1. The measurement mask time T1 is a fixed value or a value determined for each stapleless binding device 52, indicating the time during which no measurement is performed. The measurement mask time T1 is stored in the ROM 167 in advance.

In step S703, the CPU 162 measures the voltage Vm obtained by the conversion circuit 102 converting the driving voltage V for driving the motor 75 a plurality of times.

The driving voltage V varies considerably. Accordingly, in the present exemplary embodiment, the voltages Vm measured a plurality of times are averaged to improve measurement accuracy. The CPU 162 also measures an edge interval (i.e., equivalent to cycle) of the pulse signal input from the encoder sensor 90 a plurality of times, and averages the measurement results to calculate the rotation speed of the motor 75. The CPU 162 performs such measurements in measurement time T2. The measurement time T2 is set not to be longer than a difference between the measurement mask time T1 and the time in which the contact portion between the roller 93 and the cam 92 moves through the Z portion (FIG. 2A) of the cam 92. The time in which the roller 93 moves through the Z portion of the cam 92 will hereinafter be referred to as a movement period. The measurement time T2 is set to fall within a time obtained by subtracting the measurement mask time T1 from the movement period. In other words, the measurement time T2 is set so that current measurement is performed within a no-load period where little load acts on the motor 75. More specifically, the current measurement is performed in a period when the motor 75 is being driven and the upper teeth 97 are not pressing the sheet bundle S. The measurement time T2 is stored in the ROM 167. The predetermined ridge line distance (Z portion) which defines the no-load period has a fixed value or a value set according to the shape of the cam 92. In such a manner, the CPU 162 measures the driving voltage V of the motor 75 and the cycle of the pulse signal from the encoder sensor 90 within the measurement time T2. The CPU 162 resets and starts a not-illustrated timer in advance, and refers to the timer to measure the measurement time T2. As indicated by the waveforms (c) and (e) of FIG. 6, the driving current I and the output of the encoder 90 are stable during the period of the measurement time T2.

Determination of Torque Constant Kt

In step S704, the CPU 162 determines a torque constant Kt based on the cycle of the pulse signal from the encoder sensor 90 and the voltage Vm according to the driving voltage V of the motor 75, measured in step S703. In other words, the CPU 162 also functions as a determination unit for determining torque. The determination of the torque constant Kt by the CPU 162 is described in detail below. The CPU 162 determines an average value of the voltage Vm according to the driving voltage V measured a plurality of times. The CPU 162 converts the average value of the voltage Vm into the driving voltage V of the motor 75 by using data (Table 1) indicating a relationship between the voltage Vm and a motor driving voltage V, stored in the ROM 167 in advance. Table 1 lists average values of the voltage Vm [V] on the left column and driving voltages V [V] of the motor 75 converted from the respective average values of the voltage Vm on the right column. For example, if the voltage Vm has an average value of 1.35 V, the CPU 162 converts the driving voltage V of the motor 75 to 22.89 V.

TABLE 1

| Voltage Vm [V] | Motor Driving Voltage V [V] |
|---|---|
| 1.1 | 18.65 |
| 1.15 | 19.50 |
| 1.2 | 20.35 |
| 1.25 | 21.20 |
| 1.3 | 22.04 |

TABLE 1-continued

| Voltage Vm [V] | Motor Driving Voltage V [V] |
|---|---|
| 1.35 | 22.89 |
| 1.4 | 23.74 |
| 1.45 | 24.59 |
| 1.5 | 25.44 |
| 1.55 | 26.28 |
| 1.6 | 27.13 |

The CPU 162 further averages a plurality of measurement results of the pulse signal cycle from the encoder sensor 90 to calculate an average value Te. The CPU 162 then calculates a rotation angular speed ωm of the motor 75 from the average value Te of the pulse signal cycle from the encoder sensor 90 by using the following previously prepared equation (1):

$$\omega m=2\times\pi\times(1\div Te)=18. \quad (1)$$

The rotation angular speed ωm is in units of [rad/s], and the average value Te in units of [sec]. The numerical value of 18 in equation (1) is the number of slits formed in the disk on the output shaft of the motor 75.

Figure 7:
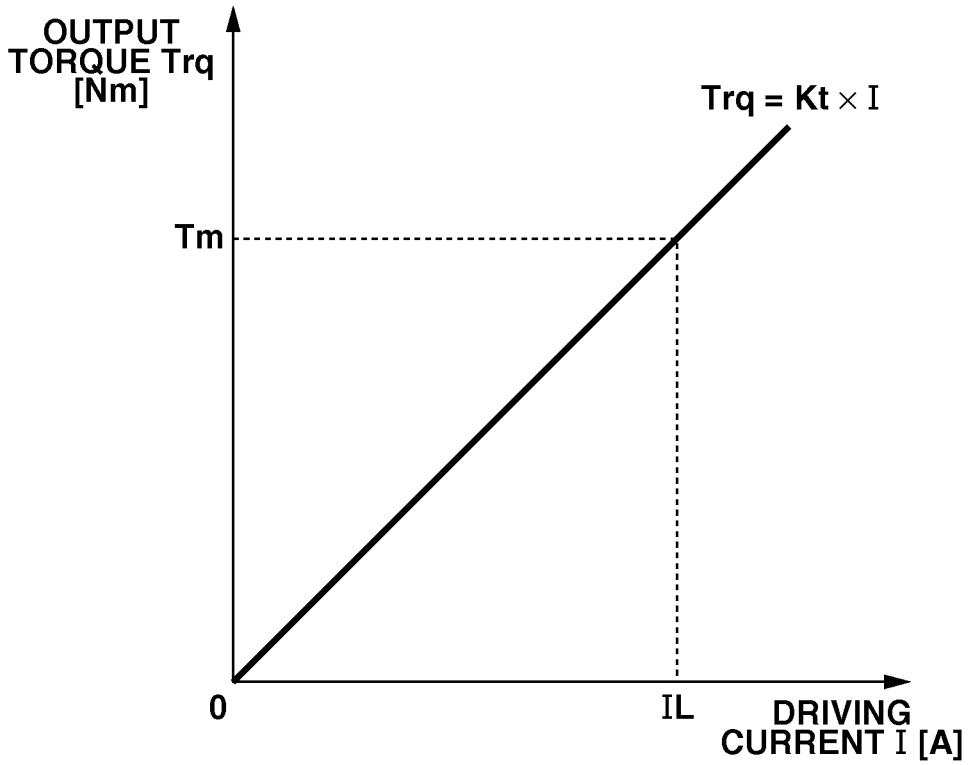
FIG. 7 is a graph illustrating an output torque characteristic.

Here, the CPU 162 determines the torque constant Kt of the motor 75. FIG. 7 is a graph in which the horizontal axis indicates the driving current I [A] of the motor 75 and the vertical axis indicates output torque Trq [Nm]. The following relationship holds:

$$Trq=Kt\times I.$$

The torque constant Kt corresponds to the gradient of the straight line illustrated in FIG. 7 and expresses an output torque characteristic of the motor 75. The torque constant Kt of the motor 75 is known to typically have a value equal to a back electromotive force constant Ke. Thus, $$Kt=Ke. \quad (2)$$

Further, the back electromotive force constant Ke can be calculated by the following equation (3): where V is the driving voltage converted from the voltage Vm of the motor 75, and ωm the rotation angular speed of the motor 75.

$$Ke=V\div\omega m, \quad (3)$$

The CPU 162 can thus determine the torque constant Kt of the motor 75 by using equation (4) derived from equations (2) and (3):

$$Kt=Ke=V\div\omega m. \quad (4)$$

The torque constant Kt is in units of [Nm/A], the driving voltage V in units of [V], and the rotation angular speed ωm in units of [rad/s]. In such a manner, the CPU 162 determines the torque constant Kt based on the measurement results of the voltage Vm according to the driving voltage V of the motor 75 and the cycle of the pulse signal from the encoder sensor 90 (equivalent to the rotation speed) in step S703. In the present exemplary embodiment, the CPU 162 determines the output torque characteristic, i.e., the torque constant Kt of the motor 75 based on the detection results of the rotation speed and the driving voltage V of the motor 75. Based on the determined torque constant Kt of the motor 75, the CPU 162 then controls the driving current I of the motor 75 so that the upper teeth 97 and the lower teeth 98 apply constant pressing force to the sheet bundle S.

In step S705, the CPU 162 outputs the limit current signal to the current limitation circuit 100 based on the torque constant Kt determined in step S704. As illustrated in FIG. 7, if the output torque needed for the stapleless binding processing is Tm [Nm], a driving current of IL [A] is needed to obtain the output torque Tm. The output torque Tm needed for the stapleless binding processing is a value determined in advance for each individual stapleless binding device 52 by experiment and stored in the ROM 167. The driving current IL [A] is the limit current value. From the torque constant Kt determined in step S704, the CPU 162 determines the limit current value IL by using equation (5):

$$IL=Tm\div Kt. \quad (5)$$

The limit current value IL is in units of [A], the torque constant Kt in units of [Nm/A], and the output torque Tm in units of [Nm].

The CPU 162 stores the determined limit current value IL in the RAM 168, and outputs the limit current value (voltage signal) according to the limit current value IL to the current limitation circuit 100.

In step S706, the CPU 162 determines whether a limit current is detected, based on whether the limit detection signal output from the current limitation circuit 100 is detected. The current limitation circuit 100 controls the driving circuit 82 so that the driving current I of the motor 75 will not exceed the limit current value IL corresponding to the limit current signal. The motor 75 continues forward rotation, and the cam 92 continues to rotate in the direction of the arrow X in FIG. 2A. As the cam 92 approaches the top dead center, the driving current I of the motor 75 increases. The current limitation circuit 100 detects the driving current I via the shunt resistor R1. If the driving current I flowing through the motor 75 is detected to have reached the limit current value IL, the current limitation circuit 100 outputs the limit detection signal to the CPU 162 (see the waveform (h) of FIG. 6). In step S706, if the CPU 162 determines that the limit detection signal is detected (YES in step S706), the processing proceeds to step S709. When the CPU 162 detects the limit detection signal, the cam 92 is in the position of the top dead center as illustrated in FIG. 2B and a predetermined pressing force is applied to the sheet bundle S by the upper teeth 97 and the lower teeth 98.

In step S706, if the CPU 162 determines that the limit detection signal is not detected (NO in step S706), the processing proceeds to step S707. In step S707, the CPU 162 refers to the timer started in step S701 and determines whether a predetermined time has elapsed. Here, the predetermined time is set to the time exceeding the time needed for the binding processing. In step S707, if the CPU 162 determines that the predetermined time has not elapsed (NO in step S707), the processing returns to step S706. In step S707, if the CPU 162 determines that the predetermined time has elapsed (YES in step S707), then in step S708, the CPU 162 transmits the CPU 161 in the image forming apparatus 1 of a time-out error because the motor 75 is not likely normally driven. The processing then proceeds to step S712.

In step S709, the CPU 162 outputs the motor driving signal to the driving circuit 82 so that the driving current I is maintained at the limit current value IL for a certain time and so that the motor 75 is braked after that. As a result, the forward rotation of the motor 75 stops. The upper teeth 97 and the lower teeth 98 mesh with the sheet bundle S at a predetermined pressure needed for binding, whereby the stapleless binding processing on the sheet bundle S is performed. The forward rotation driving of the motor 75 is quickly stopped so that the predetermined pressure is not applied to the sheet bundle S longer than needed.

In step S710, the CPU 162 outputs the motor driving signal to the driving circuit 82 so that the driving circuit 82 drives the motor 75 in the reverse rotation (CCW) direction to rotate the cam 92 in the direction of the arrow Y (clockwise) in FIG. 2B. The CPU 162 thereby separates the upper teeth 97 and the lower teeth 98 from the sheet bundle S. In step S711, the CPU 162 determines whether the ON signal is input from the reference sensor 76. If the CPU 162 determines that the ON signal is not input from the reference sensor 76 (NO in step S711), the processing returns to step S711. In step S711, if the CPU 162 determines that the ON signal is input from the reference sensor 76 (YES in step S711), then in step S712, the CPU 162 stops driving the motor 75 via the driving circuit 82 and ends the stapleless binding processing.

In FIG. 6, the level of the limit current signal indicated by the waveform (f) slightly drops after the lapse of the measurement time T2. The drop indicates that the limit current signal is updated according to the limit current value IL determined in step S705. The limit current signal according to the limit current value IL determined in the previous binding processing which is stored in the RAM 168, is used until the update of the limit current signal.

While the motor 75 is driven to rotate in the reverse rotation direction and the cam 92 is returning to the bottom dead center, the roller 93 comes into contact with the Z portion (no-load period) again. As indicated by the waveforms (c) and (e) of FIG. 6, during the no-load period in the reverse rotation period, the CPU 162 may perform the processing of step S703, i.e., measure the cycle of the pulse signal from the encoder sensor 90 and the driving voltage V a plurality of times within the measurement time T2. The detection results may be used to determine the torque constant Kt for the next binding processing.

According to the present exemplary embodiment, the number of rotations of the motor 75 and the driving voltage V of the motor 75 can be detected by an inexpensive configuration in the period when little load acts on the motor 75 performing the binding processing operation. The torque constant Kt, or the output torque characteristic of the motor 75, can be determined before a binding operation based on the detection results, i.e., the number of rotations of the motor 75 and the driving voltage V of the motor 75. Consequently, the stapleless binding device 52 can control the pressing force to maintain a constant level regardless of individual variations of the motor 75, variations in the temperature of the surroundings where the stapleless binding device 52 is installed, and variations in the output torque due to use time and use frequency. The constant control of the pressing force can improve the quality of the binding-processed sheet bundle S. As has been described above, according to the present exemplary embodiment, the quality of the stapleless binding processing can be improved and increases in the size and cost of the sheet processing apparatus 50 and the image forming apparatus 1 can be reduced.

A second exemplary embodiment will be described below. In the first exemplary embodiment, the torque constant Kt of the motor 75 is determined based on the measurement results of the driving voltage V (the voltage Vm according to the driving voltage V) and the rotation speed (the cycle of the pulse signal output from the encoder sensor 90). The second exemplary embodiment describes a configuration in which a measurement result of the driving current I is further added to improve the calculation accuracy of the torque constant Kt. The configuration of the image forming apparatus 1 (FIG. 1A), the configuration of the sheet processing apparatus 50 (FIG. 1B), and the configuration of the stapleless binding device 52 (FIGS. 2A and 2B) are similar to those of the first exemplary embodiment. A description thereof will thus be omitted.

Control Blocks of Image Forming Apparatus and Sheet Processing Apparatus

Figure 8:
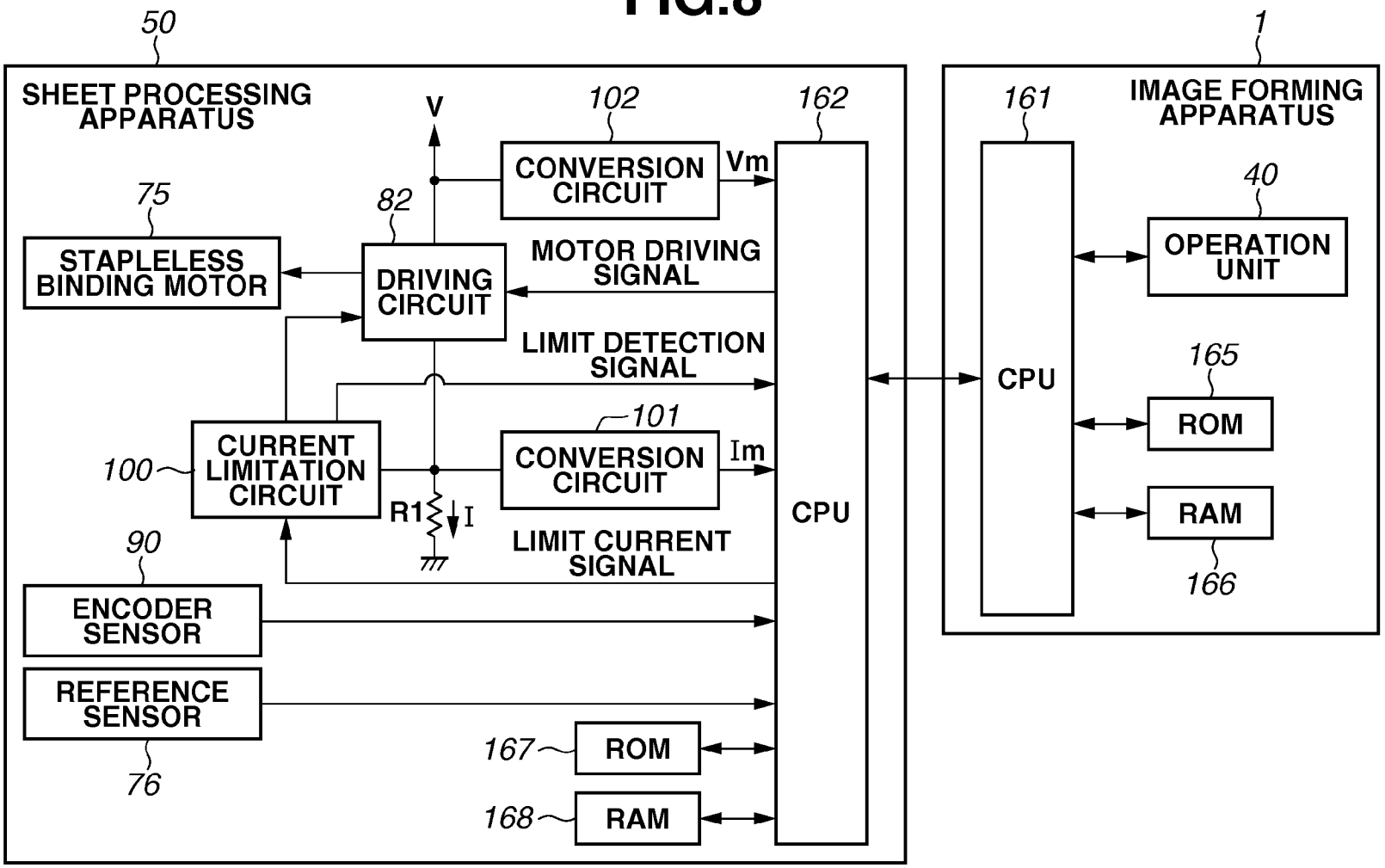
FIG. 8 is a block diagram of an image forming apparatus and a sheet processing apparatus according to a second exemplary embodiment.

FIG. 8 illustrates control blocks of the image forming apparatus 1 including the sheet processing apparatus 50 according to the present exemplary embodiment. Similar components to those of the first exemplary embodiment are denoted by the same reference numerals. A description thereof will be omitted. In the present exemplary embodiment, the voltage signal according to the driving current I of the motor 75 which arises in the shunt resistor R1, is input to a conversion circuit 101. The conversion circuit 101 is an amplification circuit that amplifies the input voltage signal to a voltage level range detectable by the CPU 162. A voltage Im converted by the conversion circuit 101 is input to the CPU 162.

Stapleless Binding Processing

Figure 9:
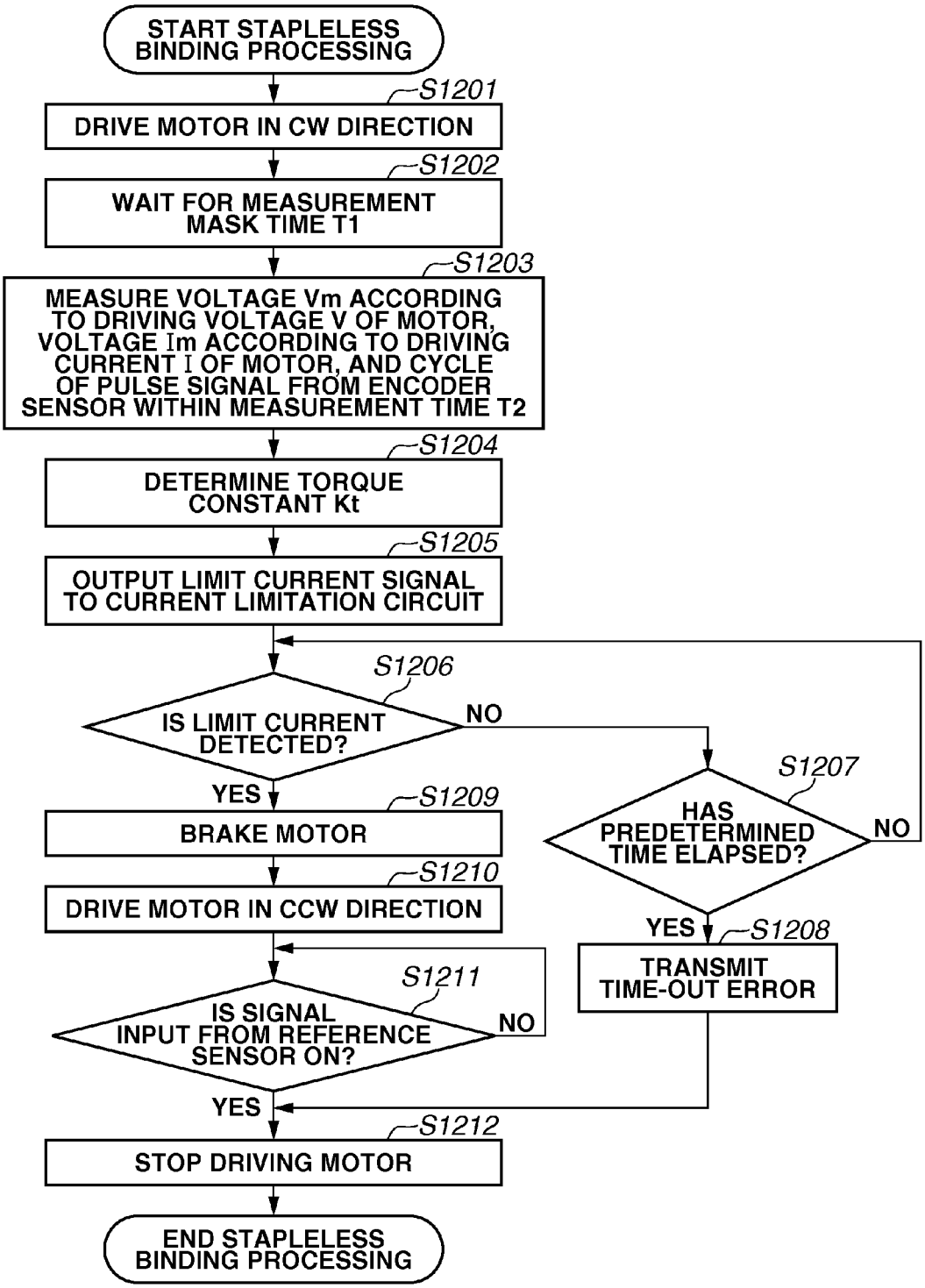
FIG. 9 is a flowchart illustrating the stapleless binding processing of the sheet processing apparatus according to the second exemplary embodiment.

Next, the control of the stapleless binding processing by the CPU 162 of the sheet processing apparatus 50 will be described with reference to the flowchart of FIG. 9. The processing of steps S1201 and S1202 is similar to that of steps S701 and S702 of FIG. 5. A description thereof will be omitted. In step S1203, the CPU 162 measures the voltage Vm according to the driving voltage V of the motor 75 via the conversion circuit 102 and the voltage Im according to the driving current I via the conversion circuit 101 a plurality of times each. Since the driving voltage V and the driving current I vary considerably, the CPU 162 measures the voltages Vm and Im a plurality of times and determines average values to improve the measurement accuracy. The CPU 162 also measures the edge interval (cycle) of the pulse signal from the encoder sensor 90 a plurality of times. The CPU 162 performs such measurements within the measurement time T2. The measurement time T2 is similar to what is described in the first exemplary embodiment.

Determination of Torque Constant Kt

In step S1204, the CPU 162 determines the torque constant Kt based on the cycle of the pulse signal from the encoder sensor 90, the voltage Vm according to the driving voltage V of the motor 75, and the voltage Im according to the driving current I of the motor 75, measured in step S1203. The determination of the torque constant Kt by the CPU 162 will be described in detail below. The CPU 162 averages voltages Vm according to the driving voltage V and voltages Im according to the driving current I measured a plurality of times during the measurement time T2. The CPU 162 converts the average value of the voltage Vm into the driving voltage V of the motor 75 by using the data illustrated in Table 1. The CPU 162 determines the drive current I based on the average value of the voltage Im by using data indicating a relationship between the voltage Im and a motor driving current I (Table 2) stored in the ROM 167 in advance. Table 2 lists average values of the voltage Im [V] on the left column and the driving current I [mA] of the motor 75 converted from the average values of the voltage Im on the right column. For example, if the voltage Im has an average value of 0.55 V, the CPU 162 determines the driving current I of the motor 75 to be 55 mA.

TABLE 2

| Voltage Im [V] | Motor Driving Current I [mA] |
|---|---|
| 0.5 | 50 |
| 0.55 | 55 |
| 0.6 | 60 |
| 0.65 | 65 |
| 0.7 | 70 |
| 0.75 | 75 |
| 0.8 | 80 |
| 0.85 | 85 |
| 0.9 | 90 |
| 0.95 | 95 |
| 1 | 100 |

Like the first exemplary embodiment, an average value Te of the pulse signal cycle from the encoder sensor 90 is calculated based on a plurality of measurements. Like the first exemplary embodiment, the rotation angular speed ωm of the motor 75 is calculated from the average value Te by using equation (1).

Here, the CPU 162 determines the torque constant Kt of the motor 75. The torque constant Kt is similar to what is described with reference to FIG. 7 of the first exemplary embodiment. A description thereof will thus be omitted. Also in the present exemplary embodiment, equation (2) holds between the torque constant Kt and the back electromotive force constant Ke. In the present exemplary embodiment, the driving current I of the motor 75 is measured during the measurement time T2, i.e., when the motor 75 is under no load. Accordingly, in the present exemplary embodiment, considering the driving current I of the motor 75, the back electromotive force constant Ke can be derived by equation (6):

$$Ke=(V-R\times I)\div\omega m, \tag{6}$$

where R is a direct-current resistance component of the motor 75. The CPU 162 can thus determine the torque constant Kt of the motor 75 by using equation (7) derived from equations (2) and (6):

$$Kt=Ke=(V-R\times I)\div\omega m. \tag{7}$$

The torque constant Kt is in units of [Nm/A], the driving voltage V in units of [V], the direct-current resistance component R in units of [Ω], and the driving current I in units of [A]. In the present exemplary embodiment, a fixed value stored in the ROM 167 in advance is used as the direct-current resistance component R of the motor 75. The driving current I is a measured value determined by the CPU 162. Even when R×I is treated as a fixed value, it has a very small effect on the determined value of the torque constant Kt. R×I may therefore be treated as a fixed value stored in the ROM 167.

In such a manner, the CPU 162 determines the torque constant Kt from equation (7) based on the driving voltage V, the driving current I, and the rotation speed of the motor 75. Like the first exemplary embodiment, the CPU 162 determines the limit current value IL according to the output torque Tm needed for the stapleless binding processing by using the determined torque constant Kt. The limit current value IL is determined by using the determined torque constant Kt, based on equation (5) described in the first exemplary embodiment. The processing of steps S1205 to S1212 is similar to that of steps S705 to S712 of FIG. 5 described in the first exemplary embodiment. A description thereof will be omitted.

As described above, the CPU 162 can determine the torque constant Kt of the motor 75 and control the driving current I flowing through the motor 75 based on the direction results of the rotation speed, the driving voltage V, and the driving current I during the operation period when substantially no load acts on the output shaft of the motor 75 in the binding processing operation. In the present exemplary embodiment, the driving current I of the motor 75 is also taken into account when determining the torque constant Kt. The torque constant Kt can thus be determined with higher accuracy. As a result, the stapleless binding device 52 can control the pressing force to maintain a constant level regardless of not only individual variations of the motor 75 but also variations in the temperature of the surroundings where the stapleless binding device 52 is installed and variations in the output torque due to use time and use frequency. The control of the pressing force to be constant can improve the quality of the binding-processed sheet bundle S.

Other Exemplary Embodiments

The foregoing exemplary embodiments are configured to determine the torque constant Kt which is the output torque characteristic of the motor 75 each time the stapleless binding processing is performed on a sheet bundle S. However, similar effects to the foregoing exemplary embodiments can be obtained by performing the measurement of the rotation speed, the driving voltage V, and the driving current I, and by determining the torque constant Kt at any of the following timings. Examples include the following configurations:

- The torque constant Kt is determined each time the stapleless binding processing is performed on a predetermined number of copies.
- The torque constant Kt is determined by driving the motor 75 in a state where a sheet bundle S is not present in the sheet processing apparatus 50 immediately after the sheet processing apparatus 50 or the image forming apparatus 1 is powered on.
- The torque constant Kt is determined only when the stapleless binding processing is performed on a predetermined-numbered copy immediately after power-on, for example, when the stapleless binding processing is performed on the first copy of a sheet bundle S.
- The torque constant Kt is determined by driving the motor 75 in a state where a sheet bundle S is not present, in an operation other than the stapleless binding processing of the image forming apparatus 1 and the sheet processing apparatus 50.

The foregoing exemplary embodiments have been described by using the sheet processing apparatus 50 installed inside the image forming apparatus 1 as an example. However, exemplary embodiments are not limited to the sheet processing apparatus 50 of such a configuration. For example, the configurations of the foregoing exemplary embodiments may be applied to the stapleless binding device 52 itself or a sheet processing apparatus that is arranged beside an image forming apparatus and is used independently of the image forming apparatus. While the foregoing exemplary embodiments have been described by using the sheet processing apparatus 50 as an example, these exemplary embodiments are not seen to be limited to a sheet processing apparatus and may be applied to an image forming apparatus that itself includes a binding unit. While the foregoing exemplary embodiments have been described by using the stapleless binding device 52 as an example, exemplary embodiments are not limited to a stapleless binding device and may be applied to other sheet binding devices or mechanisms for applying constant pressure or constant torque.

In addition, the stapleless binding device 52 according to the foregoing exemplary embodiments is configured to press the tooth dies having the protrusions and recesses against the sheet bundle S by using the DC brush motor as a driving source. By providing the operation period when little load acts on the motor 75 in the series of binding processing operations, the torque constant Kt or the output torque characteristic of the motor 75 can be detected each time. In this configuration, since the characteristic of the motor 75 can be grasped immediately before the binding operation, the pressing force can be controlled to maintain a constant level regardless of not only individual variations of the motor 75 but also variations in the temperature of the surroundings where the stapleless binding device 52 is installed and variations in the output torque due to use time and use frequency.

A control according to an exemplary embodiment for determining the torque constant Kt of the motor 75 may be applied to, for example, a half-punched binding method for making a notch in a plurality of sheets P of a sheet bundle S. Such control may also be applied to a binding method using a binding member such as ordinary staples. In other words, the control may be applied to any binding method that uses a motor for binding processing. The control may further be applied to control of a motor when performing punching processing for making a punch hole in a sheet bundle S.

As has been described above, according to the foregoing exemplary embodiments, the quality of the stapleless binding processing can be improved and increases in the size and cost of the sheet processing apparatus 50 and the image forming apparatus 1 can be reduced.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2014-010446 filed Jan. 23, 2014 and No. 2015-003136 filed Jan. 9, 2015, which are hereby incorporated by reference herein in their entirety.

What is claimed is:

1. A sheet processing apparatus comprising:

a binding unit configured to perform binding processing by pressing a sheet bundle;

a motor configured to drive the binding unit to press the sheet bundle;

a speed detection unit configured to detect a speed of the motor;

a voltage detection unit configured to detect a driving voltage of the motor; and a motor control unit configured to determine an upper limit value of a driving current of the motor based on the speed detected by the speed detection unit and the driving voltage detected by the voltage detection unit in a period when the motor is being driven and the binding unit is not pressing the sheet bundle.

2. The sheet processing apparatus according to claim 1, wherein the motor control unit is configured to determine a torque constant of the motor based on the speed detected by the speed detection unit and the driving voltage detected by the voltage detection unit, and determine the upper limit value based on the determined torque constant.

3. The sheet processing apparatus according to claim 1, wherein the motor is configured to be driven in a substantially no-load state in the period when the motor is being driven and the binding unit is not pressing the sheet bundle.

4. The sheet processing apparatus according to claim 1, wherein the motor control unit is configured to determine the upper limit value of the driving current in a period when the sheet bundle is pressed by the binding unit.

5. The sheet processing apparatus according to claim 1, further comprising a current detection unit configured to detect the driving current of the motor, wherein the motor control unit is configured to brake the motor if the driving current detected by the current detection unit reaches the upper limit value.

6. The sheet processing apparatus according to claim 5, wherein the motor control unit is configured to, after braking the motor, drive the motor such that the motor rotates in reverse.

7. The sheet processing apparatus according to claim 6, wherein the motor control unit is configured to determine the upper limit value of the driving current when the binding unit performs next binding processing, based on the speed detected by the speed detection unit and the driving voltage detected by the voltage detection unit in a period when the motor is rotating in reverse and the binding unit is not pressing the sheet bundle.

8. The sheet processing apparatus according to claim 1, wherein the motor control unit is configured to set the upper limit value of the driving current each time the binding unit performs the binding processing.

9. The sheet processing apparatus according to claim 1, wherein the binding unit includes a first pressing unit configured to press one surface of the sheet bundle and a second pressing unit configured to press another surface of the sheet bundle, the second pressing unit being arranged to be opposed to the first pressing unit, and wherein the binding unit is configured to perform the binding processing by pressing the sheet bundle between the first pressing unit and the second pressing unit.

10. The sheet processing apparatus according to claim 9, wherein the binding unit is configured to bind the sheet bundle by entangling fibers of sheets of the sheet bundle with each other.

11. The sheet processing apparatus according to clam 9, wherein the motor is configured to move the first pressing unit toward the second pressing unit, and wherein the motor control unit is configured to determine the upper limit value of the driving current based on the speed detected by the speed detection unit and the driving voltage detected by the voltage detection unit in a period before the sheet bundle is pressed by the first pressing unit and the second pressing unit.

12. An image forming apparatus comprising:

an image forming unit configured to form an image on a sheet;

a stacking unit configured to stack the sheet on which the image is formed;

a binding unit configured to perform binding processing by pressing a sheet bundle including a plurality of sheets stacked on the stacking unit;

a motor configured to drive the binding unit to press the sheet bundle;

a speed detection unit configured to detect a speed of the motor;

a voltage detection unit configured to detect a driving voltage of the motor; and a motor control unit configured to determine an upper limit value of a driving current of the motor based on the speed detected by the speed detection unit and the driving voltage detected by the voltage detection unit in a period when the motor is being driven and the binding unit is not pressing the sheet bundle.

13. A sheet processing apparatus comprising:

a binding unit configured to perform binding processing by pressing a sheet bundle;

a motor configured to drive the binding unit to press the sheet bundle;

a speed detection unit configured to detect a speed of the motor;

a voltage detection unit configured to detect a driving voltage of the motor;

a current detection unit configured to detect a driving current of the motor; and a motor control unit configured to determine an upper limit value of the driving current of the motor based on the speed detected by the speed detection unit, the driving voltage detected by the voltage detection unit, and the driving current detected by the current detection unit in a period when the motor is being driven and the binding unit is not pressing the sheet bundle.

14. An image forming apparatus comprising:

an image forming unit configured to form an image on a sheet;

a stacking unit configured to stack the sheet on which the image is formed by the image forming unit;

a binding unit configured to perform binding processing by pressing a sheet bundle including a plurality of sheets stacked on the stacking unit;

a motor configured to drive the binding unit to press the sheet bundle;

a speed detection unit configured to detect a speed of the motor;

a voltage detection unit configured to detect a driving voltage of the motor;

a current detection unit configured to detect a driving current of the motor; and a motor control unit configured to determine an upper limit value of the driving current of the motor based on the speed detected by the speed detection unit, the driving voltage detected by the voltage detection unit, and the driving current detected by the current detection unit in a period when the motor is being driven and the binding unit is not pressing the sheet bundle.

* * * * *